US006737804B2

(12) United States Patent
Kao et al.

(10) Patent No.: US 6,737,804 B2
(45) Date of Patent: May 18, 2004

(54) BARRIER RIB STRUCTURE FOR PLASMA DISPLAY PANEL

(75) Inventors: Hsu-Pin Kao, Ping Chen (TW); Yi-Sheng Yu, Taoyuan (TW); Ching-Hui Lin, Taoyuan (TW); Kuang-Lang Chen, Chungli (TW); Sheng-Chi Lee, Taipei (TW)

(73) Assignee: Chungwa Picture Tubes, Taipei (TW)

( * ) Notice: Subject to any disclaimer, the term of this patent is extended or adjusted under 35 U.S.C. 154(b) by 12 days.

(21) Appl. No.: 10/101,719

(22) Filed: Mar. 21, 2002

(65) Prior Publication Data

US 2003/0178938 A1 Sep. 25, 2003

(51) Int. Cl.[7] ..... H01J 17/49

(52) U.S. Cl. ..... 313/582; 313/292; 313/584; 313/585; 313/586; 313/587

(58) Field of Search ..... 313/582, 583, 313/584, 585, 586, 587, 292

(56) References Cited

U.S. PATENT DOCUMENTS 3,766,420 A * 10/1973 Ogle et al. ..... 313/584
6,577,062 B2 * 6/2003 Itokawa et al. ..... 313/582

* cited by examiner

*Primary Examiner*—Nimeshkumar D. Patel
*Assistant Examiner*—Sharlene Leurig
(74) *Attorney, Agent, or Firm*—Sughrue Mion, PLLC

(57) ABSTRACT

A barrier rib structure for a plasma display panel is described. The barrier rib structure formed on a back substrate has a plurality of parallel barrier ribs. Each barrier rib has a plurality of discharge spaces therein divided by separate walls. Each of the discharge spaces is connected to a small gas channel beside the barrier rib through a small connect opening.

17 Claims, 7 Drawing Sheets

BARRIER RIB STRUCTURE FOR PLASMA DISPLAY PANEL

FIELD OF THE INVENTION

The present invention relates to a plasma display panel (PDP), and more particularly to a barrier rib structure for preventing an erroneous discharge and improving luminescence efficiency.

BACKGROUND OF THE INVENTION

Plasma display panels (PDP) can be divided into two types, the direct current (DC) type and the alternating current (AC) type, according to their electrical driving mode. In FIG. 1, which illustrates a conventional AC-type PDP, glass plates 11, 12 undergo several manufacturing steps in which many functional layers are formed thereon and are then combined together by sealing the periphery of the glass plates 11, 12. A mixed gas with a predetermined ratio is then introduced into the discharge units between the glass plates 11, 12.

In FIG. 1, a plurality of parallel transparent electrodes 111 and bus electrodes 112, a dielectric layer 113 and a protective layer 114 are sequentially formed on the glass plate 11, hereinafter referred to as front plate 11. Similarly, a plurality of parallel address electrodes 121, a plurality of parallel barrier ribs 122, a fluorescencer 123 and a dielectric layer 124 are formed on the glass plate 12, hereinafter referred to as back plate 12. One transparent electrode 111 on the front plate 11 and one address electrode 121 on the back plate 12, transparent electrode 111 and address electrode 121 being perpendicularly crossed, compose a discharge unit. When a voltage is applied to a specific discharge unit, gas discharge occurs at the discharge unit between the dielectric layers 113 and 124 to induce emission of a colored visible light from the fluorescencer 123.

FIG. 2 is a schematic, cross-sectional view corresponding to FIG. 1. In a conventional AC-type PDP 10, referring to FIGS. 1 and 2 simultaneously, a plurality of parallel-arranged transparent electrodes 111 are formed on the front plate 11. Each of the transparent electrodes 111 correspondingly has a bus electrode 112 to reduce linear resistance of the transparent electrodes 111. In one discharge unit 13, a three-electrode structure, including an X electrode and an Y electrode of the transparent electrode 111 on the front plate 11 and an address electrode 121 on the back plate 12, is generally employed. When a voltage is applied to the above three electrodes of a specific discharge unit 13 to induce discharge, the mixed gas in the discharge unit 13 glows ultraviolet (UV) rays to light the fluorescencer 123 inside the discharge unit 13. The fluorescencer 123 then emits a visible light, such as a red (R), green (G) or blue (B) light. An image is thus produced by scanning the discharge unit array.

In the conventional AC-type PDP 10, the barrier ribs 122 are arranged in parallel strips on the back plate 12. The address electrode 121 between two adjacent barrier ribs 122 is disposed inside the dielectric layer 124. In the structure, the fluorescencer 123 can only be coated on the sidewalls of the barrier ribs 122 and the top surface of the dielectric layer 124, so that only three planes are utilized. In each discharge unit 13, the fluorescencer 123 is coated on a small surface area, so that a low luminescence efficiency is obtained in the conventional PDP 10.

Since an erroneous discharge may occur in a non-discharge unit 13*a*, illustrated in FIG. 3, of the conventional AC-type PDP 10, the distance d between two adjacent discharge units 13 must be increased to prevent the same. Although a larger non-discharge unit 13*a* prevents erroneous discharge, discharge units 13 are then relatively contracted, i.e. have a reduced opening ratio, and luminescence efficiency is thus decreased. Conversely, a smaller non-discharge unit 13*a* provides larger discharge units 13, but erroneous discharge then readily occurs, so that neighboring discharge units 13 are affected during operation.

In addition, no isolation is provided between the discharge region A and non-discharge region B and erroneous discharge thus readily occurs in the non-discharge region B. A conventional method for solving the erroneous discharge issue in non-discharge region B is to perform an additional treatment of forming black strips to shade a light produced in the non-discharge region B. The contrast of the conventional PDP 10 is therefore increased, but further manufacture cost is incurred.

To solve the foregoing described problems, several different kinds of barrier rib structure have been developed by PDP designers and manufacturers. For example, Pioneer Company provides a Waffle structure having sealed latticed barrier ribs. The fluorescencer can be coated on the five planes of each discharge unit, i.e. front, back, left, right and bottom planes, thereby improving luminescence efficiency by increasing the fluorescencer coating area. At the same time, each discharge unit becomes a closed space and this effectively prevents erroneous discharge in non-discharge units. Unfortunately, the closed discharge units result in greater difficulties when vacuuming and refilling gas during the manufacturing processes.

SUMMARY OF THE INVENTION

According to the above descriptions, many drawbacks occur in the barrier rib structure of conventional PDP; for example, the structure is prone to erroneous discharge, the luminescence efficiency is low, or the structure is hard to vacuum. Therefore, the present invention provides a barrier rib structure for a plasma display panel (PDP) that can resolve the above problems.

It is an object of the present invention to provide a barrier rib structure constructed by a plurality of parallel barrier ribs. Each strip-like barrier rib has a lot of discharge spaces therein divided by separate walls. Each discharge space is connected to a small gas channel beside the barrier rib through a small connect opening. The small gas channels can inhibit unsuitable discharges in non-discharge regions during gas discharging to prevent erroneous discharge. Moreover, by controlling erroneous discharge, the margin of driving voltage can be increased, so that the yield of products can be improved. Furthermore, the small gas channels in non-discharge regions are helpful to gas purging and refilling during manufacture of a PDP device.

It is another object of the present invention to provide a barrier rib structure constructed by a plurality of parallel barrier ribs. Each strip-like barrier rib has multiple discharge spaces therein divided by separate walls. Each discharge space is connected to a small gas channel beside the barrier rib through a small connect opening. The small gas channels can inhibit unsuitable discharge in non-discharge regions, so the area of non-discharge regions can be diminished to increase the area of discharge regions. Therefore, the opening ratio can be increased, and the luminescence efficiency can be improved. Four inclined sidewall planes are formed at the corners of the discharge space and a bottom sidewall plane is formed on the bottom sidewall, so that eight planes are coated with a fluorescent layer. Hence, the fluorescent coating area in each discharge space is increased, and the luminescence efficiency can thus be improved.

It is yet another object of the present invention to provide a barrier rib structure that forms an almost-closed discharge space to shut discharge energy as well as gas discharge in the discharge space, and this structure is helpful in utilizing gas discharge energy. Furthermore, the corners of the discharge space are inclined planes or arced planes that can improve uniform reception of ultraviolet rays by the fluorescent layer to increase luminescence from the fluorescent layer.

In one aspect, the present invention provides a barrier rib structure on a back substrate for a plasma display panel. The structure at least comprises a plurality of barrier ribs parallel arranged on the back substrate. Each of the barrier ribs has a plurality of discharge spaces therein isolated by separate walls. Each of the discharge spaces is connected to a gas channel between the barrier ribs through a connect opening.

In another aspect, the present invention provides a gas discharge luminescent structure for a plasma display panel. The structure at least comprises a first dielectric layer, a plurality of barrier ribs, a fluorescent layer and a second dielectric layer. The first dielectric layer has a plurality of parallel address electrodes therein. The barrier ribs are formed on the first dielectric layer, and are respectively disposed between the address electrodes. Each barrier rib has a plurality of discharge spaces therein isolated by separate walls, and each of the discharge spaces is connected to a gas channel between the barrier rib though a connect opening. The fluorescent layer is coated on the inside wall of the discharge space. The second dielectric layer having a plurality of parallel transparent electrodes therein is located on the barrier ribs to seal the discharge spaces. The transparent electrodes and the address electrodes cross at the discharge spaces.

The transparent electrode can comprise an X electrode and an Y electrode. The X and Y electrodes have a bus electrode, respectively. By applying a voltage to these electrodes, a mixed gas sealed into the discharge space generates ultraviolet rays to light the fluorescent layer such that the fluorescent layer emits the desired colored visible light.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

The present invention provides a barrier rib structure for a plasma display panel. The barrier rib structure comprises a plurality of barrier ribs. Each barrier rib includes a plurality of discharge spaces therein isolated by separate walls, and each discharge space is connected to a small gas channel between the barrier ribs through a small connect opening. When gas discharge is produced in the discharge spaces, the small gas channels and connect openings can effectively inhibit an erroneous gas discharge, and the gas channels and connect opening helpful to gas vacuuming and refilling. By controlling erroneous gas discharge, the area of the non-discharge region can be diminished and the area of the discharge region can be enlarged relatively to increase the opening ratio, thereby improving the utility of the display panel. Moreover, the barrier rib structure of the present invention provides an almost-closed discharge space in the barrier rib by which the discharge energy can be shut in the discharge space without losing energy. In addition, the coating area of fluorescent layer in each discharge space is increased and uniformly receives ultraviolet rays, so that the luminescence efficiency is increased.

Figure 1:
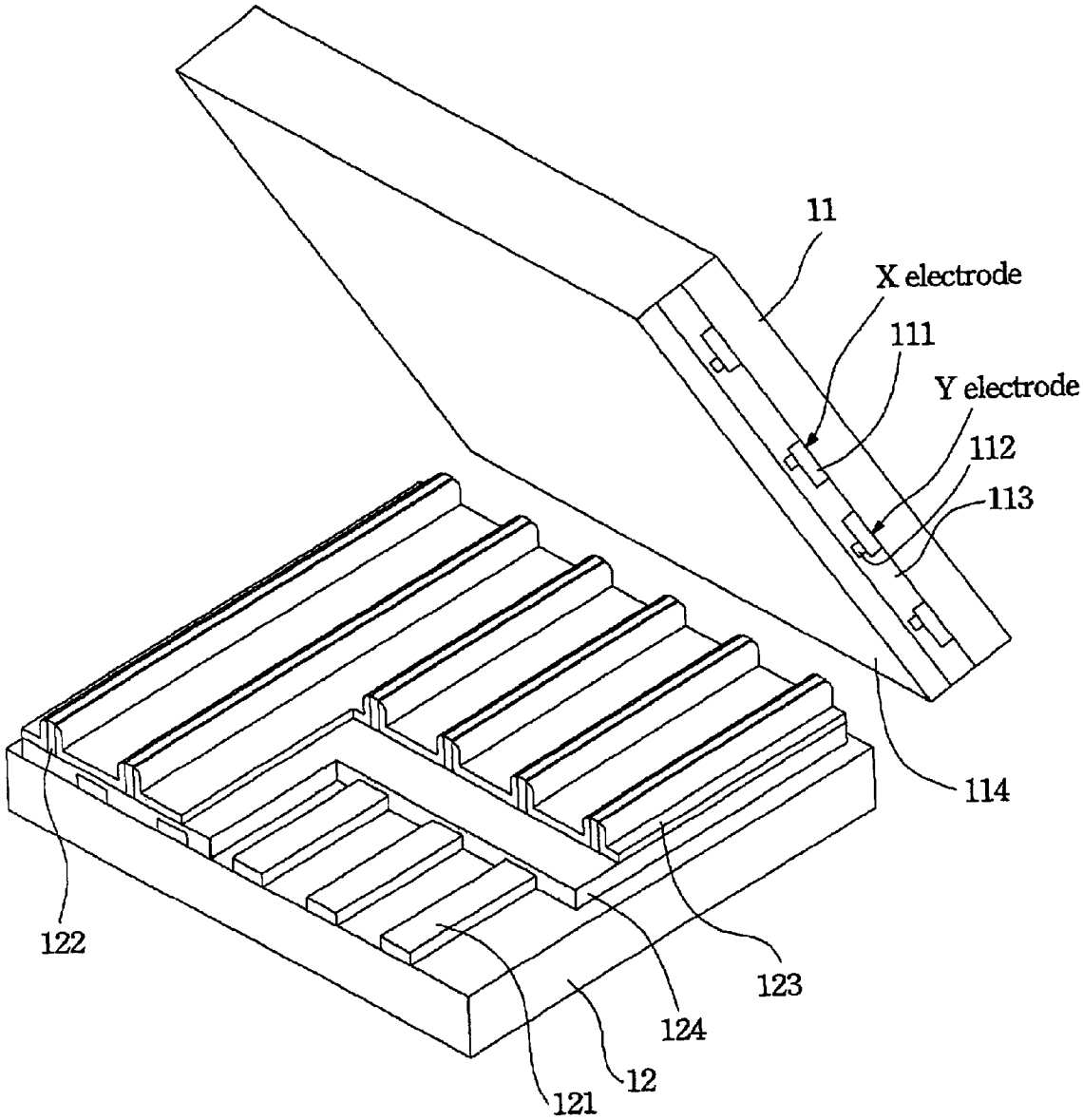
FIG. 1 (PRIOR ART)
FIG. 1 is a schematic assembly diagram of a front substrate and a back substrate of a conventional plasma display panel.
Figure 2:
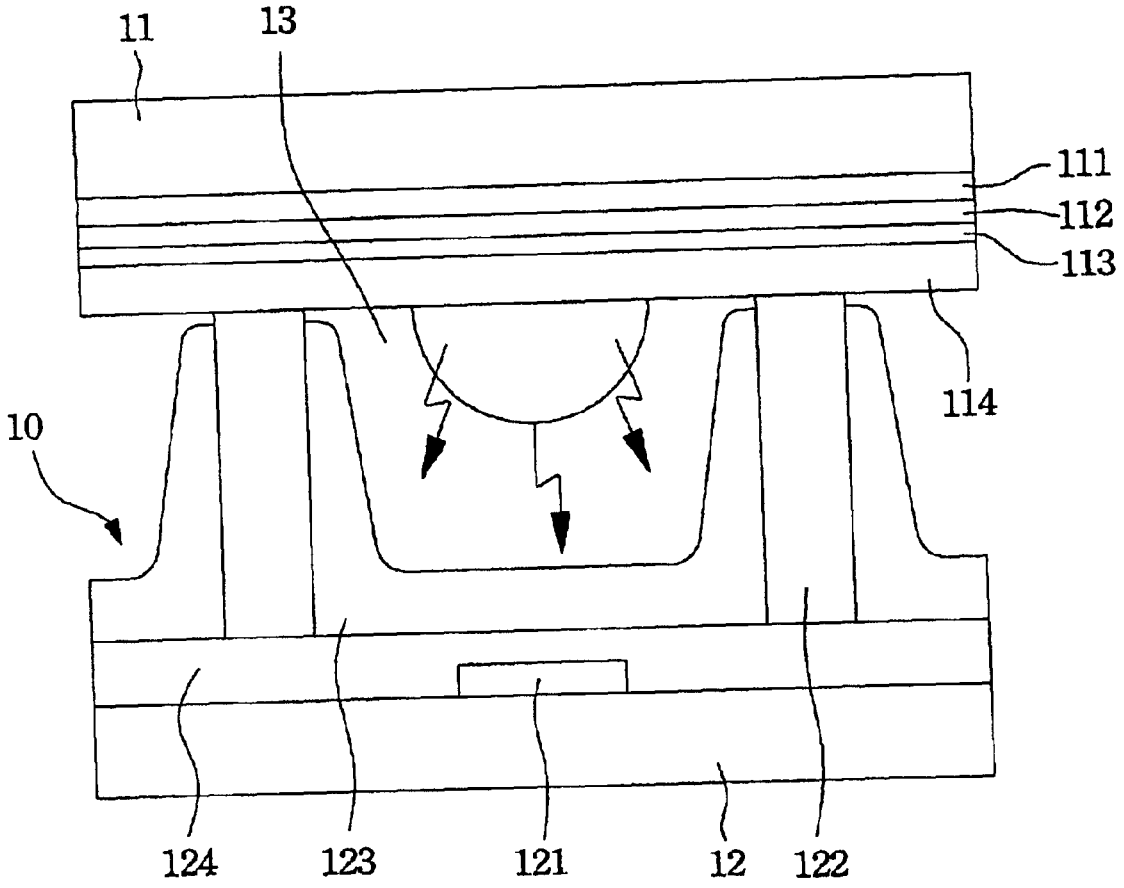
FIG. 2 (PRIOR ART)
FIG. 2 is a schematic, cross-sectional view of a conventional plasma display panel.
Figure 3:
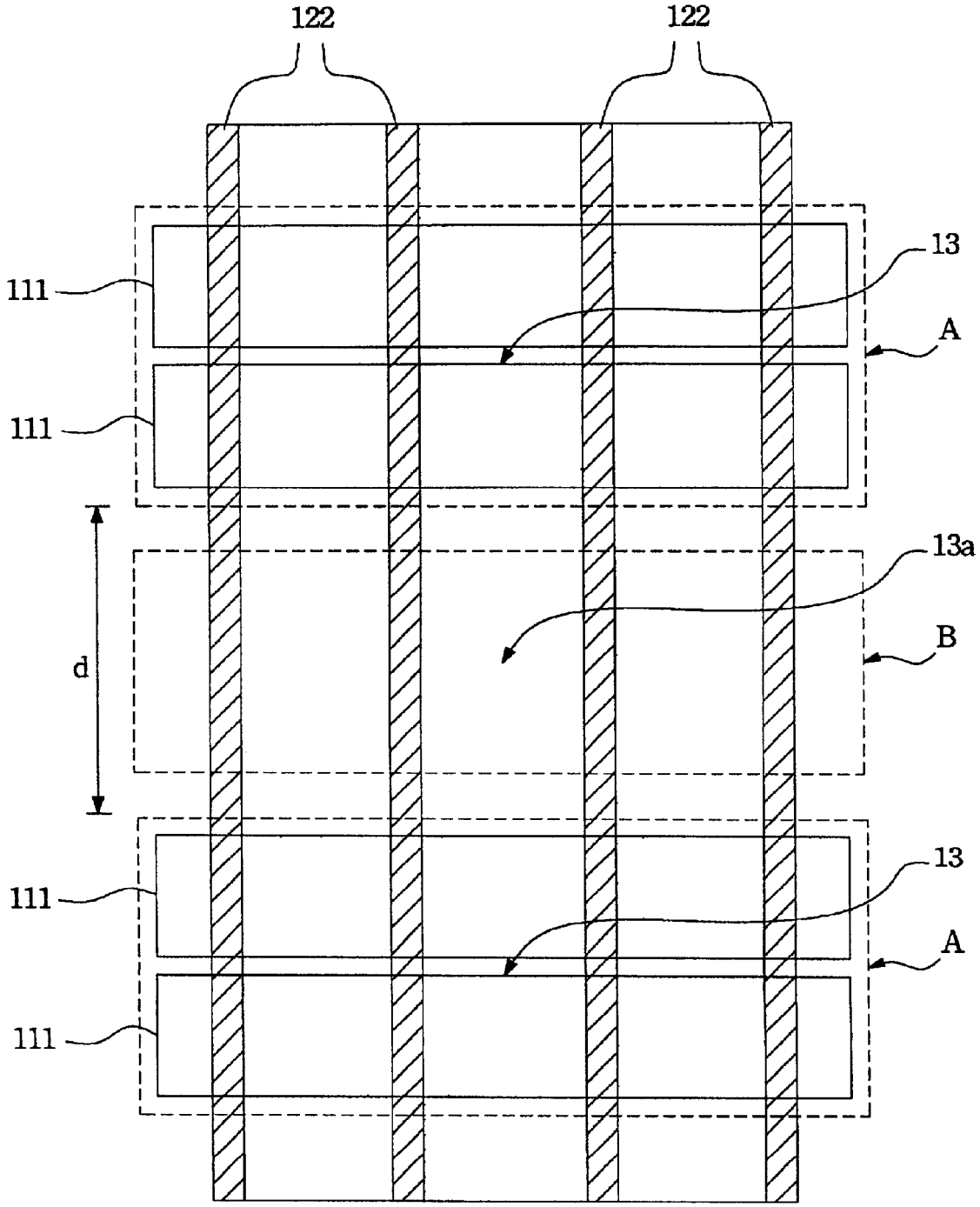
FIG. 3 (PRIOR ART)
FIG. 3 is a schematic top view of a conventional plasma display panel in the state of an erroneous discharge in a non-discharge region.
Figure 4:
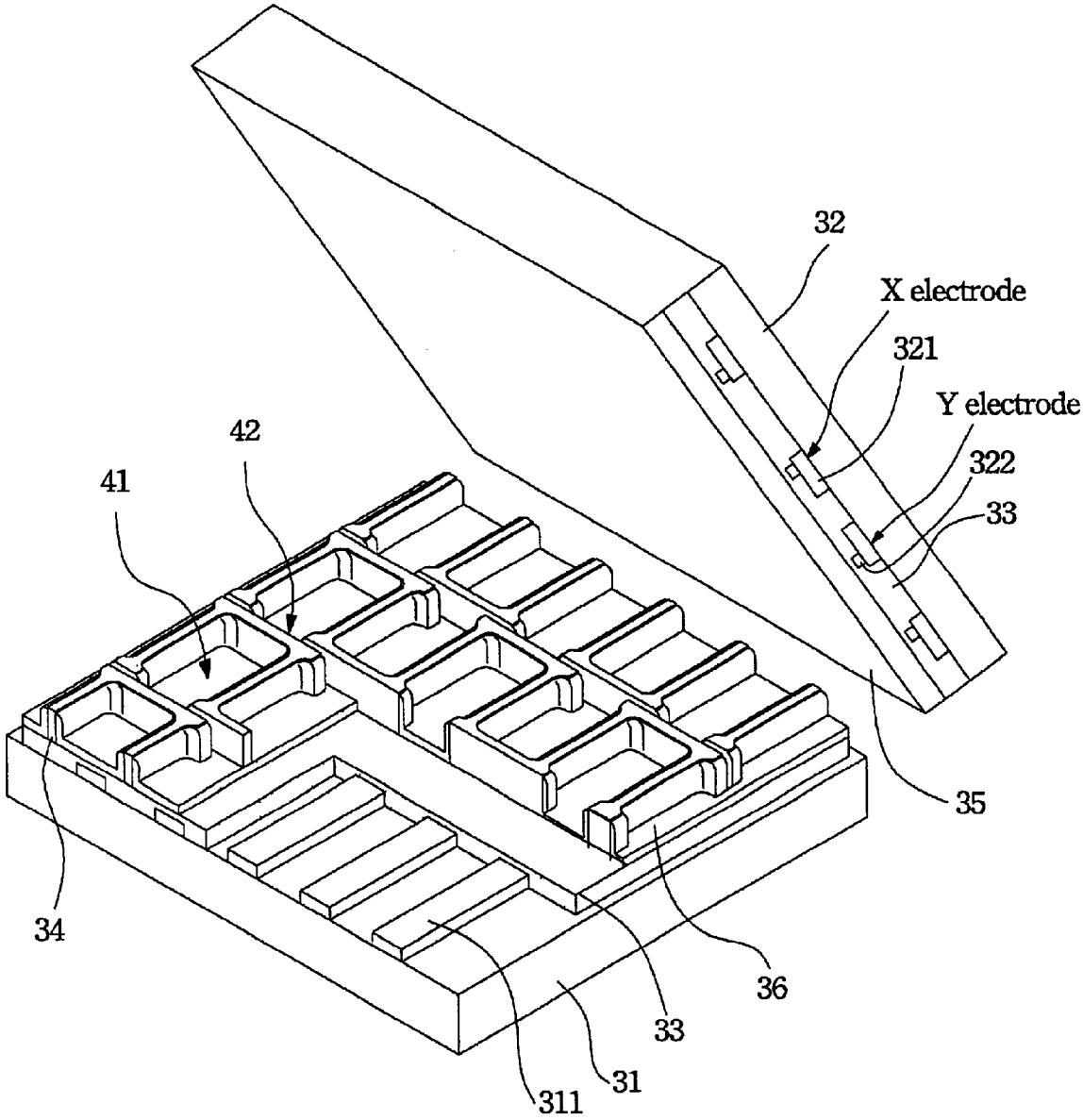
FIG. 4 is schematic assembly diagram of a plasma display panel according to one preferred embodiment of the present invention.

FIG. 4 is a schematic assembly diagram of a plasma display panel according to one preferred embodiment of the present invention. Referring to FIG. 4, the plasma display panel (PDP) of the present invention comprises a front substrate 32 and a back substrate 31. A plurality of parallel-arranged address electrodes 311 are formed on the back substrate 31 and a dielectric layer 33 is formed on the back substrate 31 to cover the address electrodes 311. A plurality of parallel-arranged barrier ribs 34 respectively located between the address electrodes 311 are formed on the dielectric layer 33. That is, one address electrode 311 is disposed between two adjacent barrier ribs 34.

On the inside surface of the front substrate 32, a plurality of parallel-arranged transparent electrodes 321, including an X electrode and an Y electrode, is formed. Each transparent electrode 321 has a bus electrode 322 thereon, respectively. A dielectric layer 33 is formed on the front substrate 32 to cover the transparent electrodes 321 and bus electrodes 322. A protective layer 35 is formed on the dielectric layer 33. When the substrates 31, 32 are combined together and the steps of vacuuming and refilling with mixed gas having a determined mixed ratio of special gas, such as He, Ne, Ar, or Xe, are completed, the address electrodes 311 on the back substrate 31 and the transparent electrodes 321 on the front substrate 32 are perpendicularly crossed to form the corresponding discharge units.

Figure 5:
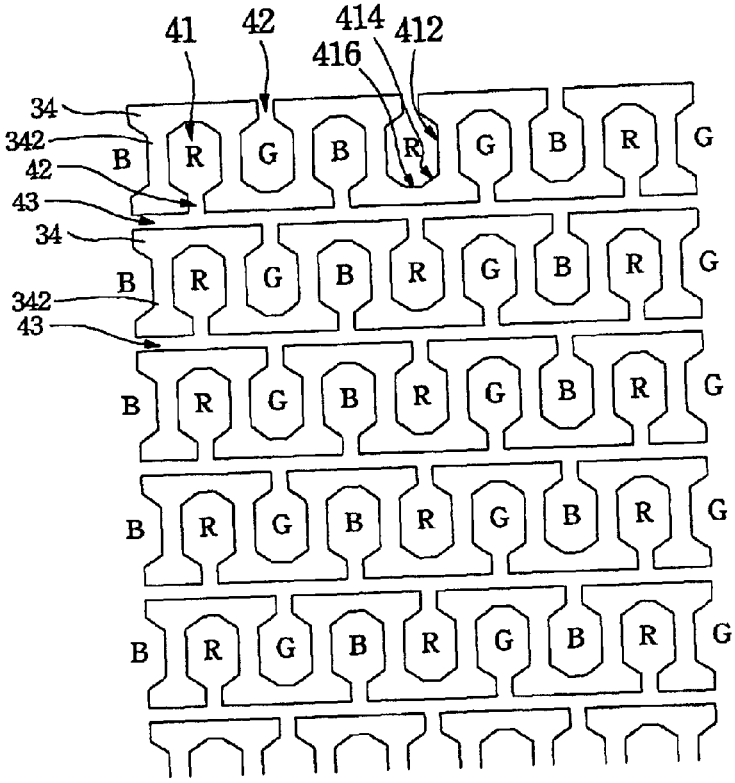
FIG. 5 is a schematic top view of a barrier rib structure on a back substrate according to one preferred embodiment of the present invention.
Figure 6:
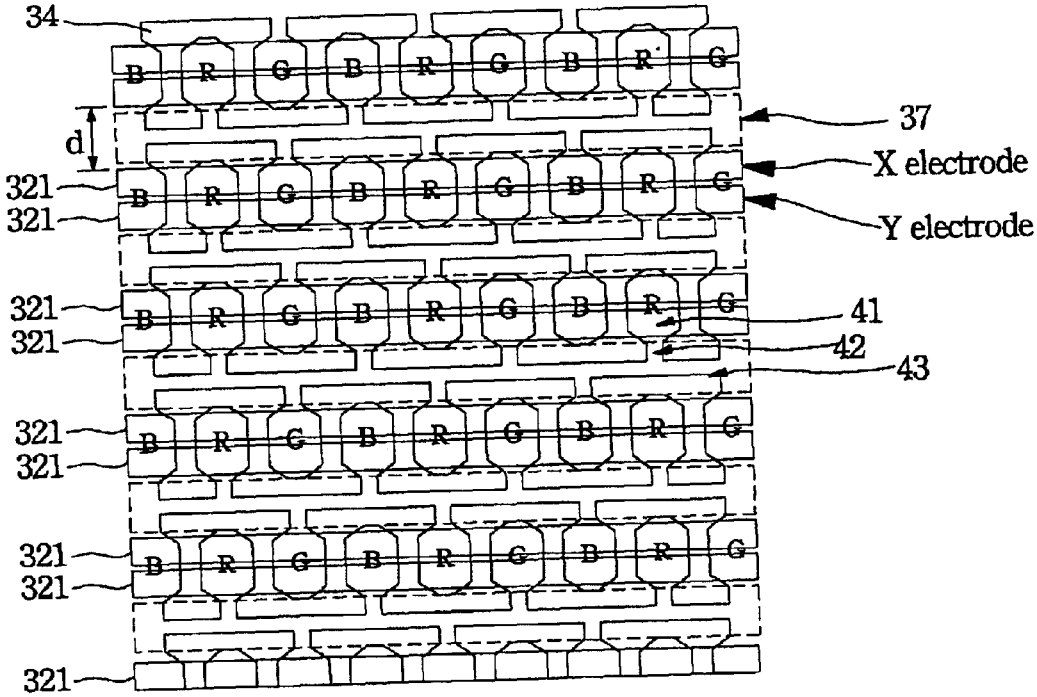
FIG. 6 is a schematic top view of a barrier rib structure coordinated with X and Y electrodes on a front substrate according to one preferred embodiment of the present invention.

Referring to FIGS. 5 and 6, a plurality of barrier ribs 34 are disposed on the back substrate 31 of the present invention. The barrier ribs 34 and the address electrodes 311 are alternately parallel arranged, i.e. one address electrode 311 is located between two adjacent barrier ribs 34, as shown in FIG. 4. The back substrate 31 is divided into two regions. One is a discharge region where the regions the transparent electrodes 321 are located, including the X and Y electrodes, and the other one is a non-discharge region where the regions have a distance d between the transparent electrodes 321. The barrier ribs 34 are both strip-like and parallel-arranged on the back substrate 31, and between the barrier ribs 34 are small center gas channels 43. Each barrier rib 34 includes a plurality of discharge spaces therein isolated by separate walls, respectively. Each discharge space is connected to one gas channel 43 beside the barrier rib 34 through a small connect opening 42. In the preferred embodiment, the connect openings 42 of each barrier rib 34 are alternatively connected to the gas channels 43 beside the barrier rib 34, as shown in FIG. 5. The width of the connect openings 42 and the gas channel 43 are comparatively smaller than that of the discharge space 41, and are respectively about ½ to 1/20 of the width of the discharge space 41. Since the connect openings 42 are quite small, each of the discharge space 41 is an almost-closed space. The almost-closed discharge space 41 can shut discharge energy in the discharge space 41 to decrease energy losses during gas discharge such that the luminescence efficiency can be improved. During the process of fabricating the plasma display panel, the steps of gas vacuuming and refilling can be smoothly performed without damage to the plasma display panel. Moreover, since erroneous discharge does not occur, the width d of the non-discharge region can be narrowed so that the area of each discharge space 41 can be correspondingly enlarged to increase the opening ratio when designating the size of the barrier ribs 34.

Figure 9:
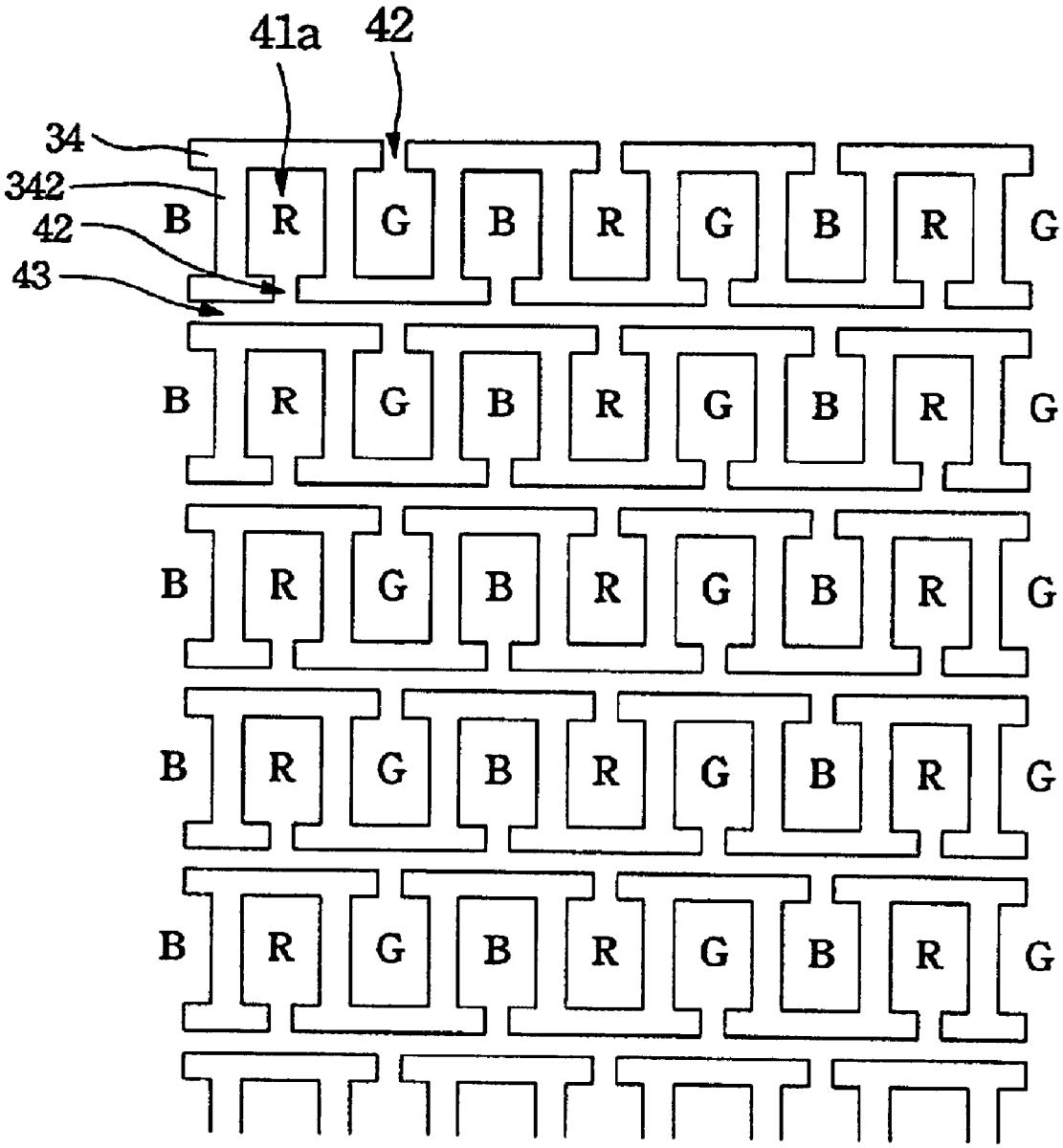
FIG. 9 is a schematic top view of a barrier rib structure of which the discharge spaces are designed to a shape of quadrangle according to a further preferred embodiment of the present invention.

In one preferred embodiment, the discharge space 41 has a shape similar to an octagon. Each discharge space 41 has two lateral sidewall planes 412, four inclined sidewall planes 414 at the corners and a bottom sidewall plane 416 opposite to the connect opening 42. In this layout, the coating planes in each discharge space 41 are increased to 8 planes from the conventional 3 planes, including one bottom sidewall plane and two lateral sidewall planes. Therefore, 4 inclined sidewall planes and 1 bottom sidewall plane are added to increase the fluorescencer coating area. When a voltage is applied to the transparent electrodes 321 and the address electrodes 311, gas discharge occurs in the discharge space 41 through the dielectric layers 33 on the front substrate 32 and back substrate 31 to generate ultraviolet rays from the mixed gas sealed therein. The ultraviolet rays light the fluorescent layer 36 inside the discharge space 41 to produce colored lights, such as a red, green, or blue visible light. Therefore, the luminescence efficiency is increased by increasing of the fluorescencer coating area. In addition, the bottom sidewall plane 416 and two adjacent to the inclined sidewall planes 414 can be continuously formed and be designed as an arced sidewall plane. Similarly, the inclined sidewall planes 414 adjacent to the connect opening, 42 can also be designed to arced sidewall planes. Preferably, the arced sidewall planes are substantially equidistant to the center of the discharge space 41. The inclined sidewall planes 414 or arced sidewall planes can uniformly receive ultraviolet rays during gas discharging to emit uniform colored visible lights. Accordingly, the brightness of the PDP of the present invention is about 10–50% higher than that of the conventional PDP. Moreover, referring to FIG. 9, the discharge space can be designed to a tetragonal discharge space 41*a*. In this layout, the size of the connect opening 42 should be noticed to prevent gas molecules accumulating in the corners of the discharge space 41*a*, which would affect the result of vacuuming.

Since the connect openings 42 are quite small, the barrier ribs 34 in the non-discharge region are relatively thicker. Therefore, the structure strength is enhanced, and the portions of the barrier ribs 34 in the discharge region can be much thinner. Accordingly, the size of the discharge region can be enlarged, and the erroneous discharge problem can be prevented so that the margin of driving margin can be improved. During the process of fabricating the barrier ribs 34, peeling of the photosensitive material layer does not occur because of the meandrous structure of the barrier ribs 34. Furthermore, the discharge space 41 of different barrier ribs 34 are preferably arranged in columns, as shown in FIGS. 5 and 6, so that the process of printing the fluorescencer for the fluorescent layer 36 is similar to the conventional strip barrier ribs, and the problem of disproportion and color mixing does not occur. A black-colored material or anti-reflective materials can be used to form the top portion of the barrier ribs 34 so that the process of forming black strip 37 can be skipped while still maintaining the function thereof. Therefore, the yield can be improved and the manufacture cost can be decreased.

Figure 7:
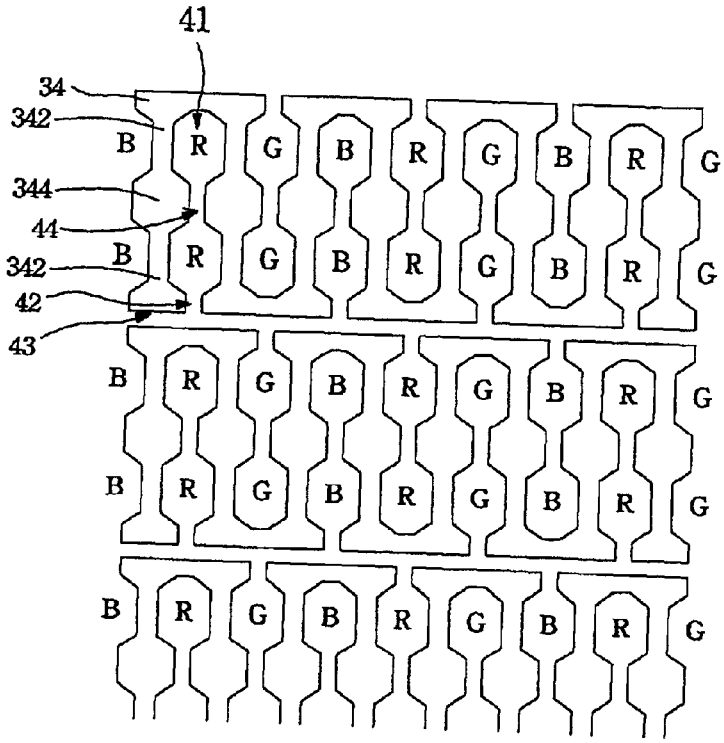
FIG. 7 is a schematic top view of a barrier rib structure of which two discharge spaces are connected in series to a gas channel through one common connect opening according to another preferred embodiment of the present invention.

FIG. 7 is a schematic top view of a modified embodiment of the present invention. A plurality of nodes 344 comprising two side-expanded trapezoid bulges can be formed in the separate walls 342. The original discharge space 41 can be divided into two. Each of the divided discharge spaces keeps the original function of one discharge space. The divided discharge spaces are connected with an inner gas channel therebetween, and the nodes 344 can improve the structure strength of the barrier ribs 34. Correspondingly, several nodes 344 can be designed in one separate wall 342 to divide the discharge space 41 into several.

Figure 8:
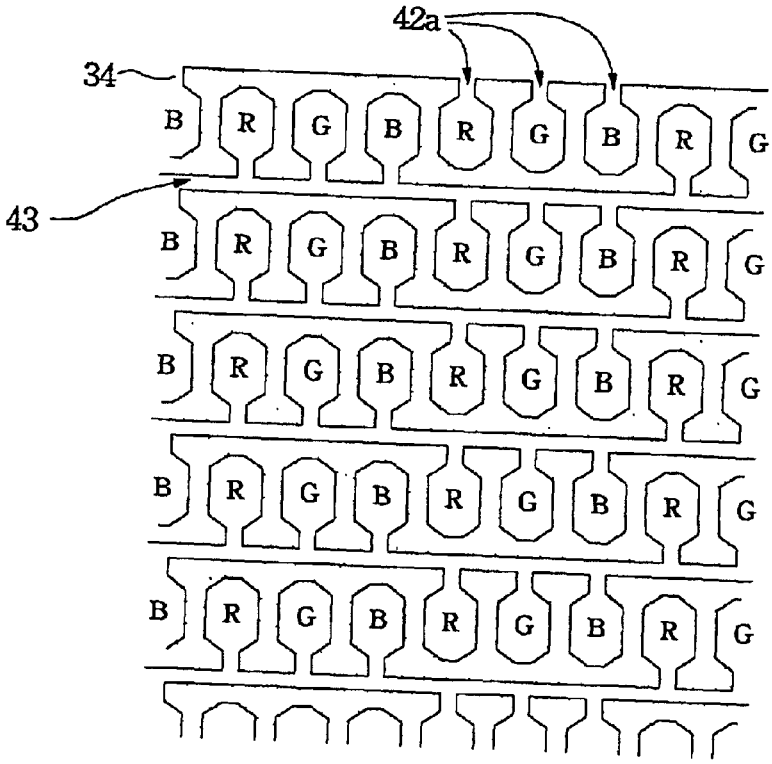
FIG. 8 is a schematic top view of a barrier rib structure of which connect openings are in unit of one pixel alternatively connected to the gas channels beside the barrier rib according to a yet preferred embodiment of the present invention.

FIG. 8 is a schematic top view of a barrier rib structure according to yet another preferred embodiment of the present invention. In this embodiment, the connect openings 42*a* are in units of one pixel alternately connected to the gas channels beside the barrier rib 34, as shown in FIG. 8. For example, one pixel includes at least three discharge spaces 41 radiating different visible lights, such as red, green and blue lights. In this arrangement, the uniformity of one pixel can be increased, and the color of each pixel can be more stable.

According to above description, the present invention provides a barrier rib structure for a plasma display panel. In the barrier ribs, the discharge spaces are isolated by separate walls, and connected to the small gas channels through the small connect openings. The small connect openings can inhibit erroneous discharge and be helpful to gas vacuuming and refilling. Each almost-closed discharge space can shut the discharge energy in the discharge space during gas discharging, so the luminescent brightness of each discharge space can be improved.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structure.

What is claimed is:

1. A barrier rib structure for a plasma display panel formed on a back substrate, the barrier rib structure comprising:

serpentine barrier ribs being arranged in a parallel direction to define discharge spaces having connect openings by curvatures, respectively, each of the barrier ribs being sidewalls of the discharge spaces, and each of the discharge spaces connecting to a gas channel between neighboring barrier ribs through one of the connect openings.

2. The structure of claim 1, wherein each of the discharge spaces defined by two lateral and four inclined sidewall planes, formed by one of the serpentine barrier ribs, and one bottom plane.

3. The structure of claim 1, wherein portions of the barrier ribs being the sidewall between the neighboring discharge spaces have at least one node structure composed of two side-expanded trapezoid bulges to divide one discharge space into two discharge sub-spaces connected by an inner gas channel therebetween.

4. The structure of claim 1, wherein the sidewalls and bottom planes of the discharge spaces are coated with a fluorescent layer.

5. The structure of claim 1, wherein a width of the connect openings is smaller than that of the discharge spaces.

6. The structure of claim 1, wherein a width of the gas channels is smaller than that of the discharge spaces.

7. The structure of claim 1, wherein a top portion of the barrier ribs is made of an anti-reflective material.

8. A gas discharge luminescent structure of a plasma display panel, comprising:

a first dielectric layer having a plurality of parallel address electrodes therein;

serpentine barrier ribs being parallel arranged in a direction perpendicular to the address electrode, each of the serpentine barrier ribs define discharge spaces having connect openings by curvatures, respectively, the barrier ribs being sidewalls of the discharge spaces, and each of the discharge spaces connecting to a gas channel between neighboring barrier ribs through the connect opening;

a fluorescent layer on the sidewalls, formed by the barrier ribs, and a bottom plane, formed by the first dielectric layer, of the discharge spaces; and a second dielectric layer on the barrier ribs, the second dielectric layer having a plurality of parallel transparent electrodes therein, the transparent electrodes crossing the address electrodes and on the discharge spaces.

9. The structure of claim 8, wherein each of the discharge spaces defined by two lateral and four inclined sidewall planes, formed by one of the serpentine barrier ribs, and one bottom plane.

10. The structure of claim 8, wherein portions of the barrier ribs being the sidewall between the neighboring discharge spaces have at least one node structure composed of two side-expanded trapezoid bulges to divide one discharge space into two discharge sub-spaces connected by an inner gas channel therebetween.

11. The structure of claim 8, wherein the sidewalls and bottom planes of the discharge spaces are coated with a fluorescent layer.

12. The structure of claim 8, wherein a width of the connect openings is smaller than that of the discharge spaces.

13. The structure of claim 8, wherein a width of the gas channels is smaller than that of the discharge spaces.

14. The structure of claim 8, wherein a top portion of the barrier ribs is made of an anti-reflective material.

15. The structure of claim 8, wherein each of the transparent electrodes comprises an X electrode and a Y electrode.

16. The structure of claim 15, wherein the X electrode and the Y electrode have a bus electrode, respectively.

17. The structure of claim 8, further comprising a protective layer between the barrier ribs and the second dielectric layer.

* * * * *

UNITED STATES PATENT AND TRADEMARK OFFICE

CERTIFICATE OF CORRECTION

PATENT NO. : 6,737,804 B2
DATED : May 18, 2004
INVENTOR(S) : Hsu-Pin Kao et al.

It is certified that error appears in the above-identified patent and that said Letters Patent is hereby corrected as shown below:

Title page,
Item [73], Assignee, "Chungwa Picture Tubes" should read -- Chunghwa Picture Tubes --.

Signed and Sealed this

Fifth Day of April, 2005

JON W. DUDAS
*Director of the United States Patent and Trademark Office*